United States Patent [19]

Long

[11] Patent Number: 4,909,749

[45] Date of Patent: Mar. 20, 1990

[54] ELECTRICAL SOCKETS

[76] Inventor: Jason Long, 4 Mount Morris Ave., White Plains, N.Y. 10604

[21] Appl. No.: 303,622

[22] Filed: Jan. 27, 1989

[51] Int. Cl.[4] ..... H01R 13/639

[52] U.S. Cl. ..... 439/263; 439/372; 439/373

[58] Field of Search ..... 439/263, 345–347, 439/369, 372, 373, 261

[56] References Cited

U.S. PATENT DOCUMENTS

| | | | |
|---|---|---|---|
| 2,198,504 | 4/1940 | Pool | 439/346 |
| 2,213,020 | 8/1940 | Scott | 173/332 |
| 2,704,831 | 3/1955 | Smith | 439/347 X |
| 3,543,218 | 11/1970 | Archer | 339/74 |
| 3,543,544 | 12/1970 | Efston | 70/57 |
| 3,710,304 | 1/1973 | Warner et al. | 439/263 X |
| 3,891,289 | 6/1975 | Hanke | 439/263 X |
| 3,947,081 | 3/1976 | Peterson | 439/261 |
| 4,136,919 | 1/1979 | Howard et al. | 439/346 |
| 4,390,226 | 6/1983 | Hohn | 439/261 |
| 4,566,297 | 1/1986 | Hawley | 70/57 |
| 4,700,997 | 10/1987 | Strand | 439/372 |

*Primary Examiner*—Steven C. Bishop
*Attorney, Agent, or Firm*—Rodman & Rodman

[57] ABSTRACT

Electrical sockets are disclosed, having insulated housings with apertured end walls for receiving the contact blades of an electrical plug. One socket includes transversely spaced first and second contact bars therein capable of limited movement relative to the housing. This socket also includes first means movable between first and second positions for blocking such limited movement when in its first position and allowing such limited movement when in its second position. It further includes second means movable therein for clamping the contact blades and bars against the first means when the latter is in its first position, thereby to lock the contact blades in the housing, the movement of the first means to its second position serving to unclamp the contact blades and bars to allow the blades to be withdrawn from the housing. Another socket includes transversely spaced first and second contact bars positioned therein. This socket includes first and second clamping means positioned adjacent to and outboard of the first and second contact bars, respectively, for clamping the contact blades and bars together, when actuated, to inhibit removal of the contact blades from the housing, and for unclamping the contact blades and bars, when deactuated, to allow removal of the contact blades from the housing. It further comprises camming means coupled to the clamping means for moving the latter between their actuated and deactuated conditions; and, actuating means coupled to the camming means for moving the same between first and second positions, thereby to move the clamping means between its acuated and deactuated conditions.

11 Claims, 5 Drawing Sheets

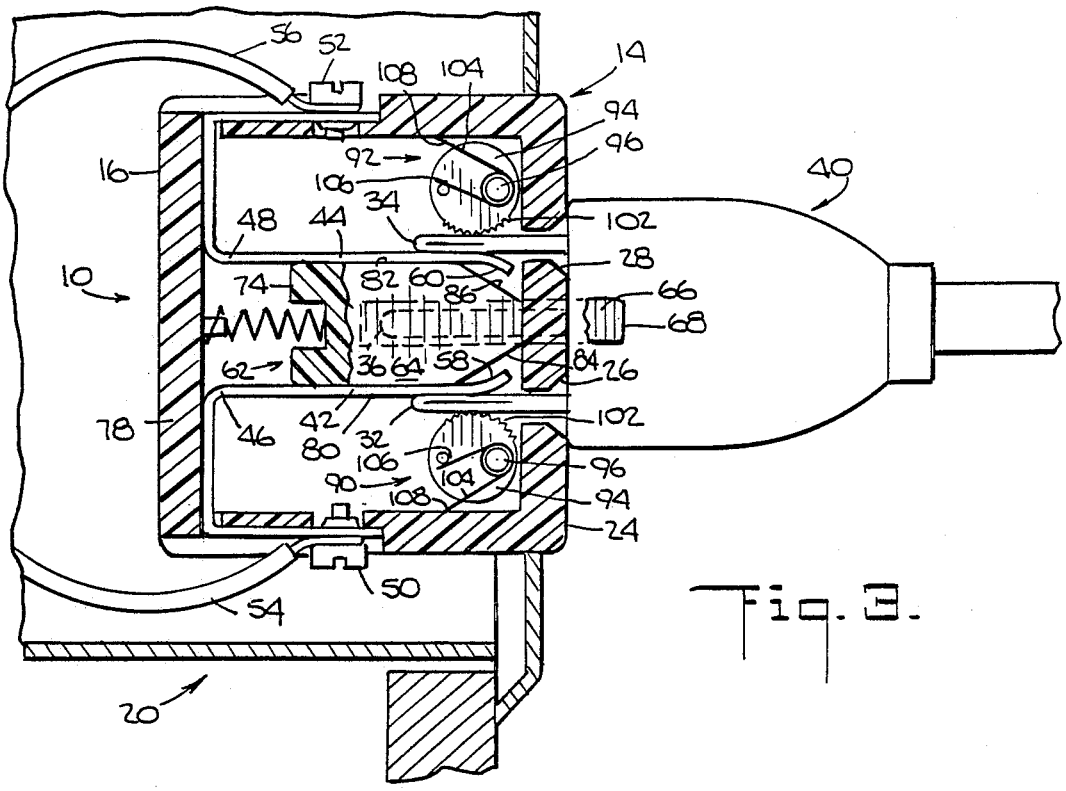
Fig. 3.
Fig. 4.
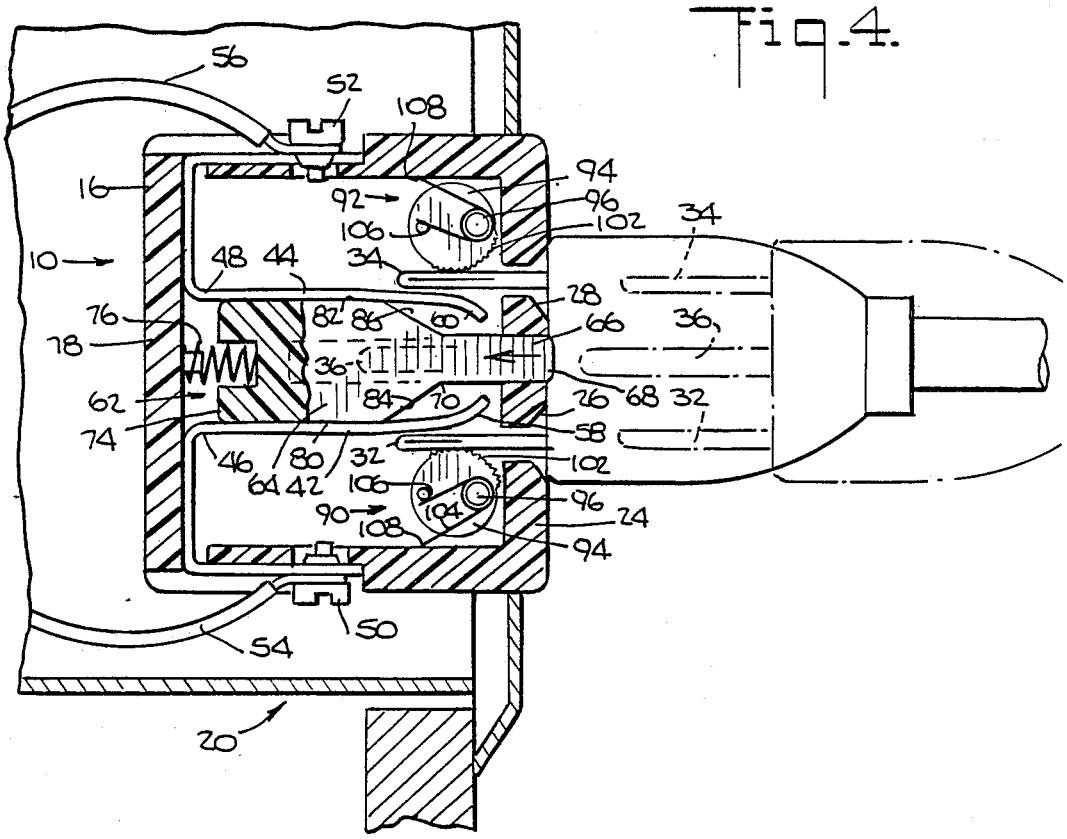

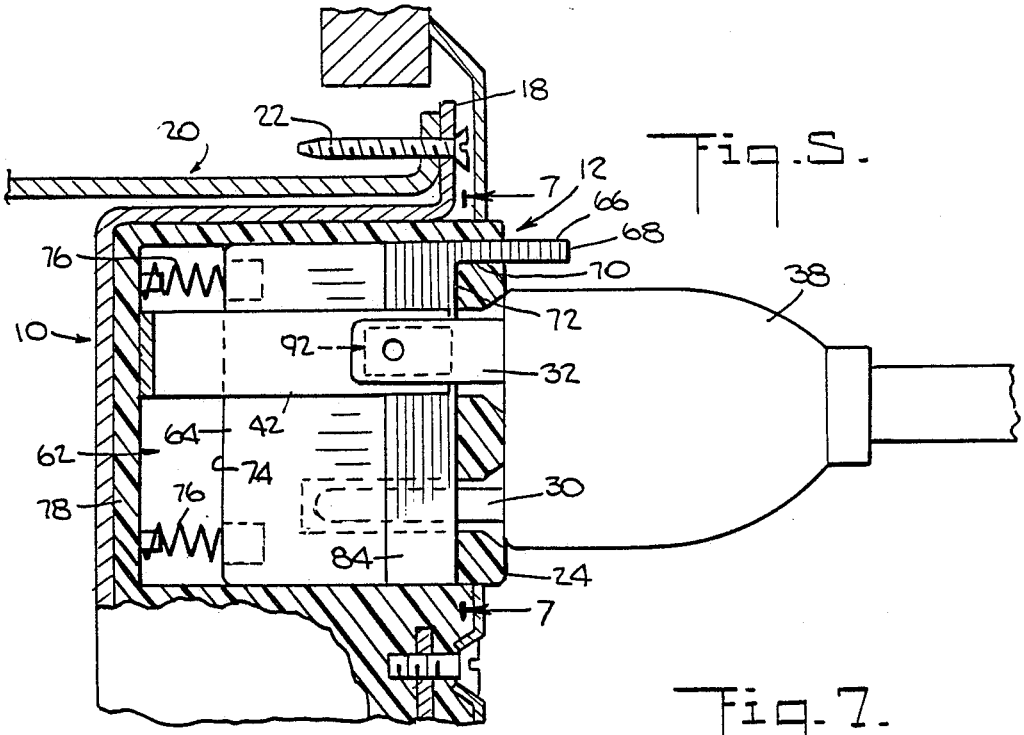
Fig. 5.
Fig. 7.
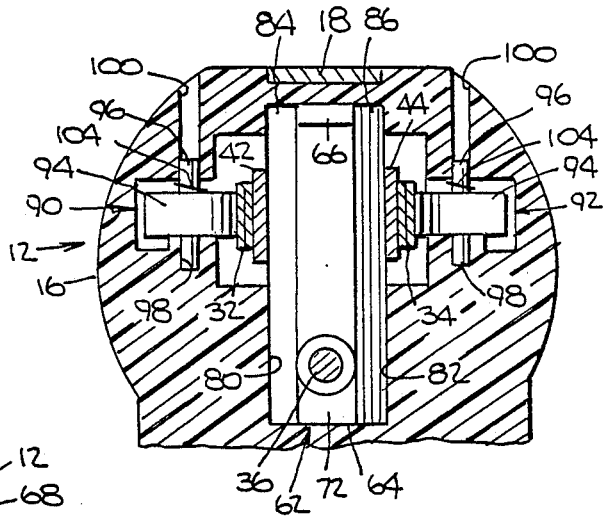
Fig. 6.
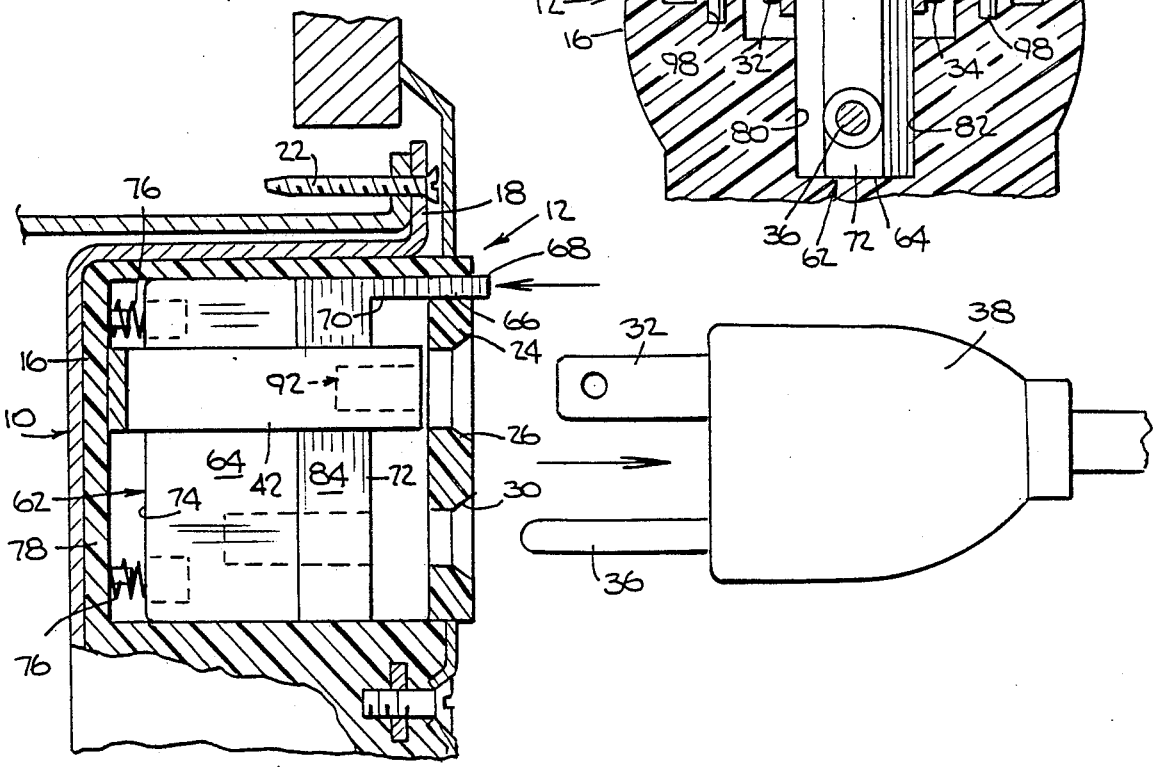

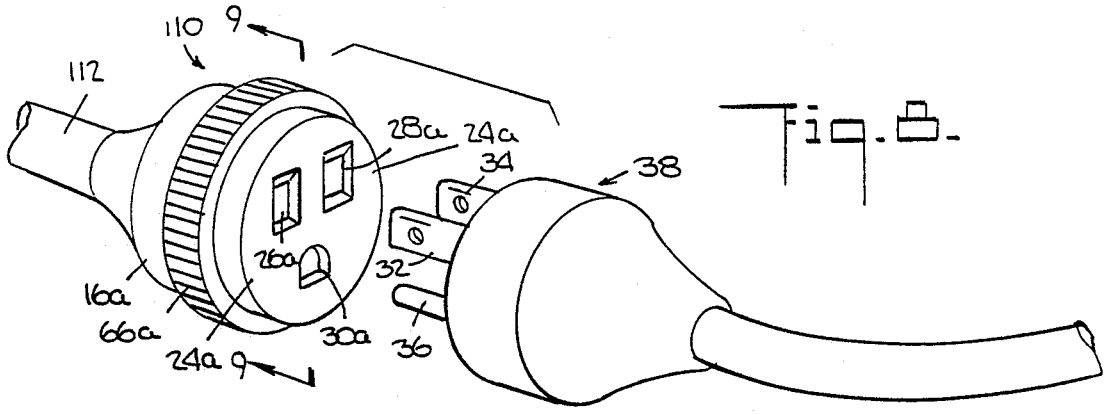
Fig. 8.
Fig. 9.
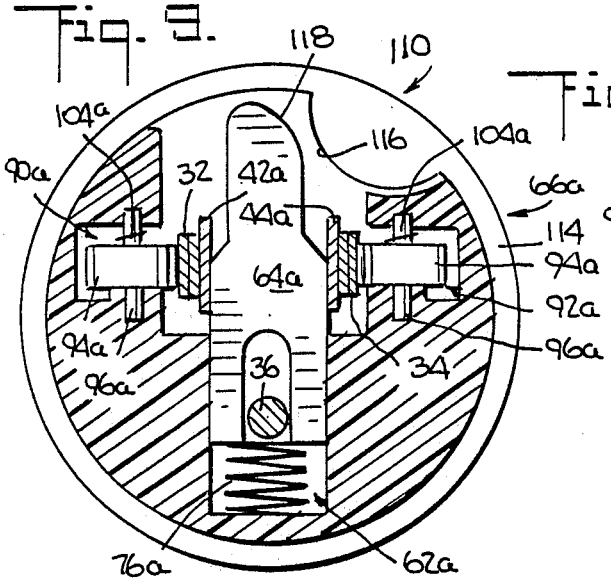
Fig. 10.
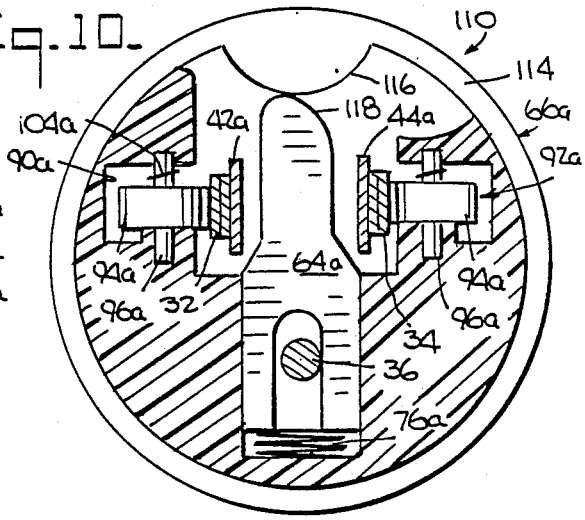
Fig. 11.
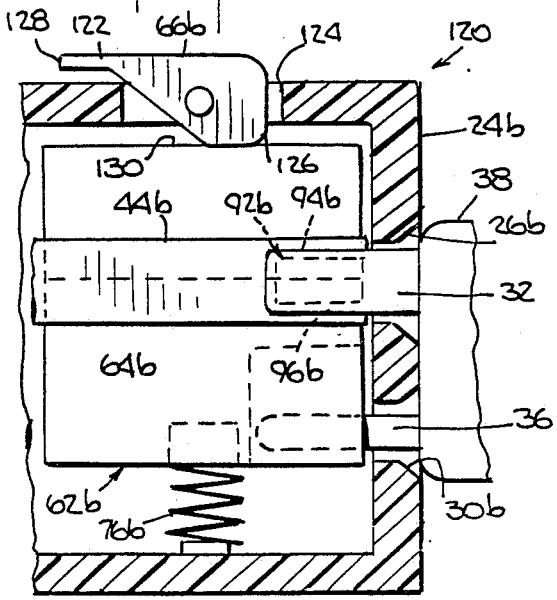
Fig. 12.
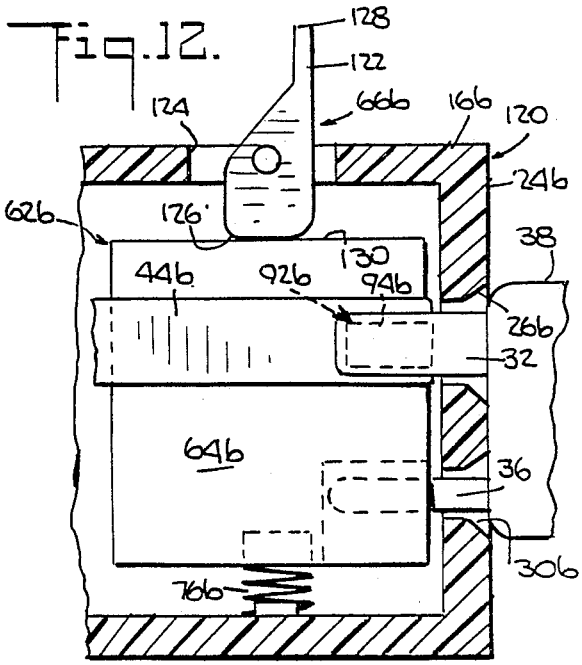

ELECTRICAL SOCKETS

TECHNICAL FIELD

This invention relates to electrical sockets and, more particularly, to electrical sockets having releasable locking mechanisms to lock the contact blades of electrical plugs therein.

BACKGROUND OF THE INVENTION

Electrical sockets of the two-conductor type normally found in conventional electrical wall receptacles and electrical extension cords generally include an insulated housing and a pair of transversely spaced, longitudinally elongate, electrically conductive, contact bars or strips therein. In three-conductor type sockets a grounded contact member is provided in addition to the transversely spaced contact bars. The contact bars of both types of sockets are generally parallel to one another and are provided either with flexed, slightly bowed, central portions or with flexed re-entrant, or bent-back, portions so that when the contact blades of electrical plugs are inserted into the socket, the flat faces of the blades and bars abut one another and the flexed portions of the bars tend to frictionally retain the blades in the socket by pressing them against the insulated housing.

Although the foregoing arrangement provides some degree of protection for users of an electrical appliance or tool to which the electrical cord and plug are connected by tending to retain the plug in the socket against disconnecting forces due to gravity and due to minor tugs made on the electrical cord by the user, a significant safety threat still remains because live plug contact bars may be exposed to the user's grasp when he or she tries to disconnect the plug from the socket. Moreover, annoying inconvenience may be encountered by users in having to reinsert inadvertently disconnected plugs. These problems have caused considerable thought to be given to the development of electrical sockets that have releasable locking mechanisms therein which lock the contact blades of electrical plugs more securely to the interiors of the sockets.

One commonly used approach for providing improved retention of the plug contact blades in the sockets has been to provide transversely movable, spring-urged detent balls in the insulated housing of the socket. These balls cooperate with corresponding detent apertures in the plug contact blades. When the plug blades are then inserted into the sockets, the balls enter the apertures in the plug blades and thereby hold the plugs in the sockets more securely than in the earlier cases. One example of such detent type electrical socket may be seen in U.S. Pat. No. 2,198,504 to A. R. Pool. Related approaches, employing extra spring pressure to hold the contact blades and contact bars more firmly together, are shown in U.S. Pat. Nos. 2,213,020 to L. A. Scott and 4,700,997 to J. E. Strand. Although providing somewhat better retention, these arrangements still allow inadvertent withdrawal of the plugs when the electrical cords are tugged and as the resilience of the springs used therein decays with age.

Another approach for more securely locking the plugs to the sockets has been to provide transversely extending, movable pins in the socket housing or on the socket contact bars, and corresponding apertures on the plug contact blades. When the plug blades are then inserted into the sockets, the pins enter the apertures in the plug blades, either by camming or by spring action, and thereby hold the plugs in the sockets until the pins are physically withdrawn from the apertures by decamming or other manipulation. Examples of such electrical sockets may be seen in U.S. Pat. Nos. 2,704,831 to W. R. Smith, 3,543,218 to A. M. Archer, and 4,136,919 to G. W. Howard et al. These arrangements also suffer from one or more of a number of disadvantages, such as being complex, costly, having short service lives and being inadaptable to use both in an electrical wall receptacle environment and in an extension cord environment.

Non-electrical sockets having releaseable electrical plug-locking mechanisms therein are also well known. Such sockets are employed to temporarily disable electrical plugs by preventing them from being connected to electrical sockets in order to preclude unauthorized use of the electrical equipment attached to the plugs. Examples of such non-electrical sockets may be seen in U.S. Pat. Nos. 3,543,544 to E. N. Efston and 4,566,297 to R. C. Hawley. These sockets, of course, are not useable as electrical sockets since they have no electrical contact bars therein.

It is, therefore, a primary object of this invention to provide an electrical socket having a releasable plug-locking mechanism that overcomes many of the disadvantages associated with prior known sockets.

Another object of this invention is to provide an electrical socket having a releasable plug-locking mechanism therein that employs a simple, positive, locking arrangement and that will operate effectively over a long, relatively trouble-free, service life.

Further objects and advantages of this invention will become apparent as the following description proceeds.

SUMMARY OF THE INVENTION

Briefly stated, and in accordance with one embodiment of this invention, there is provided an electrical socket comprising a housing of insulating material having an apertured end wall adapted to allow a pair of electrically conductive contact blades of an electrical plug to be inserted therethrough. The socket includes transversely spaced, electrically conductive, first and second contact bars positioned within the housing, which contact bars are adapted to be contacted by the contact blades and are constructed and arranged for limited movement relative to the housing. The socket also includes first means carried by the housing and movable between first and second positions for blocking the limited movement of the contact bars when in its first position and allowing the limited movement of the contact bars when in its second position. The socket further includes second means movably carried by the housing for clamping the contact blades and contact bars against one another and against the first means when the first means is in its first position thereby to lock the contact blades in the housing, the movement of the first means to its second position serving to unclamp the contact blades and contact bars and to allow the contact blades to be withdrawn from the housing.

In accordance with another aspect of this invention there is provided an electrical socket comprising a housing of insulating material having an apertured end wall adapted to allow a pair of electrically conductive contact blades of an electrical plug to be inserted therethrough. The socket includes transversely spaced, electrically conductive, first and second contact bars positioned within the housing, which contact bars are adapted to be contacted by the contact blades. The socket also includes first and second clamping means positioned adjacent to and outboard of the first and second contact bars, respectively, for clamping the contact blades and the contact bars together, when actuated, to inhibit removal of the contact blades from the housing, and for unclamping the contact blades and contact bars, when deactuated, to allow removal of the contact blades from the housing. The socket further comprises camming means movably mounted within the housing and coupled to the first and second clamping means for moving the clamping means between their actuated and deactuated conditions; and, actuating means accessible from outside of the housing which extend through a wall of the housing and are coupled to the camming means for moving the camming means between its first and second positions thereby to move the clamping means between its actuated and deactuated conditions.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

FIG. 3 is a sectional view, similar to FIG. 2, showing the condition of the socket after the plug contact blades have been inserted into it;

FIG. 4 is a sectional view, similar to FIGS. 2 and 3, showing the condition of the socket when the releasable locking mechanism thereof has been deactuated to allow the plug blades to be withdrawn from the socket;

FIG. 5 is a sectional elevation view, taken along the line 5—5 of FIG. 1 and with parts omitted for clarity, showing the condition of the socket after the insertion of the plug contact blades into the socket;

FIG. 6 is a sectional view, similar to FIG. 5, showing the condition of the socket when the releasable locking mechanism thereof has been deactuated to allow the plug blades to be withdrawn from the socket;

FIG. 7 is a sectional elevation view, taken along the line 7—7 of FIG. 5 and with parts omitted for clarity;

FIG. 8 is a perspective view of an alternate embodiment of this invention in which embodiment the electrical socket is mounted on the end of an extension cord;

FIG. 9 is a sectional elevation view, taken along the line 9—9 of FIG. 8 and with parts omitted for clarity, showing the condition of the electrical socket after the contact blades of an electrical plug have been inserted into the socket;

FIG. 10 is a sectional view similar to FIG. 9, showing the condition of the electrical socket after the releasable locking mechanism thereof has been deactuated to allow withdrawal of the plug contact blades from the socket;

FIGS. 11 and 12 are sectional elevation views of another extension-cord-mounted embodiment of the invention, with the releasable locking mechanism of the socket being illustrated in an actuated condition in FIG. 11, which condition locks the plug blades in the socket, and being illustrated in a deactuated condition in FIG. 12, which condition allows the plug blades to be withdrawn from the socket;

DETAILED DESCRIPTION OF THE INVENTION

Figure 1:
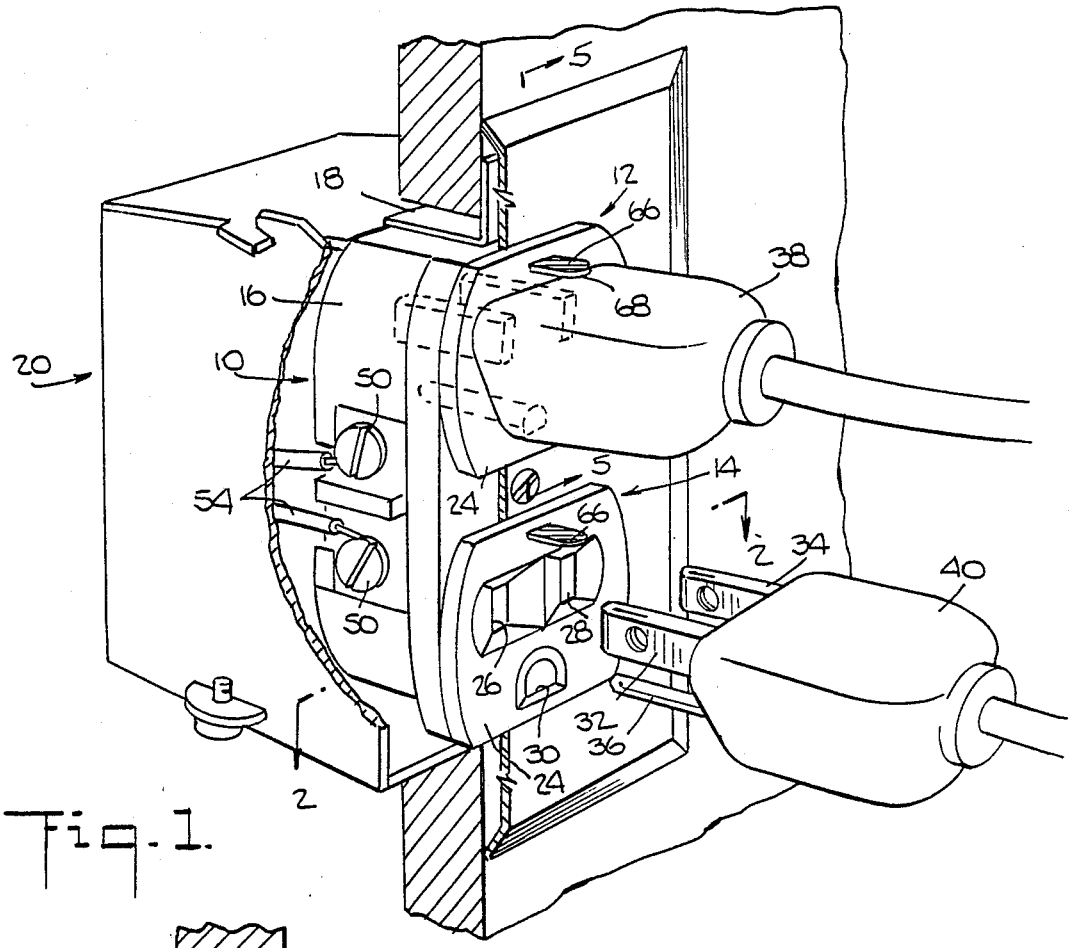
FIG. 1 is a perspective view, with parts broken away and omitted for clarity, of a wall-receptacle-mounted electrical socket in accordance with this invention.

Referring now to FIGS. 1–7, a pair of electrical sockets in accordance with a preferred embodiment of this invention has been illustrated generally at 10. The pair of electrical sockets 10 includes upper and lower substantially similar sockets, shown generally at 12 and 14, respectively, which are formed in a common insulating housing 16. The housing 16 is fixedly carried by a bracket member 18 that is, in turn, bolted to an electrical wall box or receptacle, shown generally at 20, by suitable screws, one of which is shown at 22.

Each of the electrical sockets 12, 14 includes a front end wall portion 24 of housing 16, which end wall portion is provided with apertures 26, 28 and 30 therein adapted to allow electrically conductive corresponding contact blades 32 and 34 and a contact pin 36 of substantially similar electrical plugs, shown generally at 38 and 40, to be inserted therethrough. The transversely spaced contact blades 32 and 34 of the plugs are adapted to contact electrically conductive, transversely spaced, corresponding contact bars or strips 42 and 44 when they are inserted into the sockets 12 and 14. The contact pins 36 of the plugs are adapted to contact electrically conductive, corresponding grounded contact members (not shown) in the sockets when they are inserted into the sockets.

The contact bars 42 and 44 of the sockets each have corresponding ones of their ends 46 and 48, respectively, fixedly supported on the insulating housing 16. The ends 46 and 48 are electrically connected to respective terminals 50 and 52 which, in turn, have respective electrical conductors 54 and 56 connected to them in accordance with conventional practices. The other ends 58 and 60 of contact bars 42 and 44 are supported by the fixed ends of the contact bars and the intervening lengths of the contact bars. They are thus capable of limited transverse movement due to the flexibility of the intervening lengths of the contact bars.

A first means or blocking means, shown generally at 62, carried by the housing 16, is provided within each of the sockets 12 and 14 and is movable between first and second positions for blocking the limited movement of the contact bars 42 and 44 when it is in its first position and allowing the limited movement of the contact bars when it is in its second position. The blocking means 62 includes a movable wedge member portion 64, and an actuating means 66 therefor which extends through the end wall 24 of the housing 16 and has one end 68 thereof adapted to be pushed toward the end wall by a user. The other end 70 of the actuating means is coupled to one end 72 of the wedge member portion 64, for example by being integrally molded therewith or by by being fastened thereto.

Figure 2:
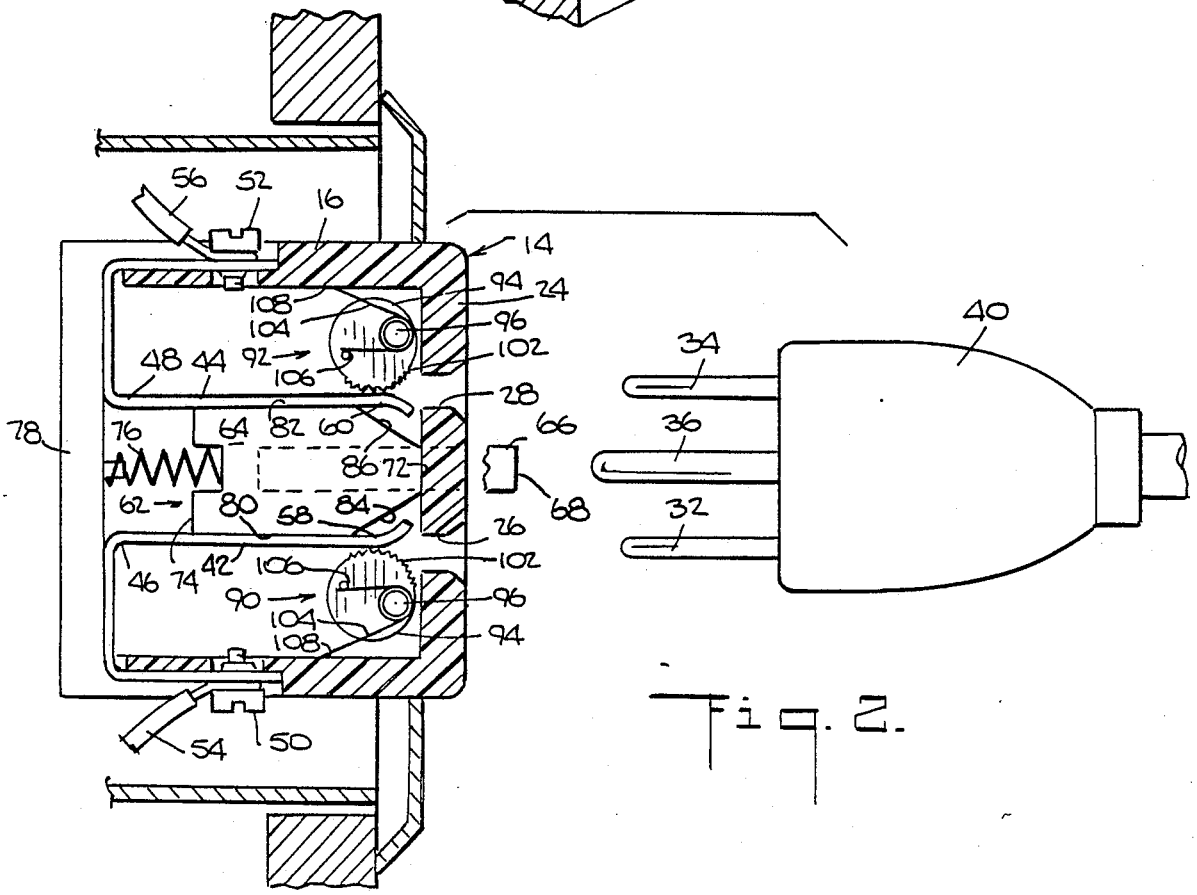
FIG. 2 is a sectional plan view, taken along the line 2—2 of FIG. 1 and with parts omitted for clarity, showing the condition of the electrical socket prior to the insertion of the contact blades of an electrical plug into the socket.

The other end 74 of wedge member 64 is biased by springs 76 to move away from a rear end wall 78 of housing 16, toward the forward end wall 24 thereof. When the forward end 72 of the wedge member is in abutment with the forward end wall 24, as shown in FIGS. 2, 3 and 5, this position constitutes the first position of the blocking means 62. When the end 68 of the actuating means 66 is depressed, the wedge member 64 moves toward the rear end wall 78 of the housing and when the end 74 of the wedge member is positioned adjacent to the rear end wall 78, as shown in FIGS. 4 and 6, this position constitutes the second position of the blocking means 62.

The wedge member 64 is provided with transversely spaced parallel surface portions 80 and 82, and with surface portions 84 and 86 that taper toward one another in the direction of the front end 72 of the wedge member. When the wedge member is in its first position, portions of its parallel surfaces 80 and 82 overlap end portions of the contact blades 32 and 34 of plug 40, preventing the free ends 58 and 60 of the socket contact bars 42 and 44, which are positioned between the overlapping portions of the parallel surfaces 80 and 82 and the blades 32 and 34, from moving toward one another in the overlapped area, as shown in FIG. 3. When wedge member 64 is in its second position, the tapered surface portions 84 and 86, rather than the parallel surface portions 80 and 82, overlap the end portions of the plug contact blades 32 and 34. Accordingly, the free ends 58 and 60 of the socket contact bars 42 and 44 may flex toward one another, as shown in FIG. 4.

The electrical sockets 12 and 14 are each also provided with second means or clamping means, shown generally at 90 and 92, movably carried by the housing 16, for clamping the plug contact blades 32, 34 and socket contact bars 42, 44 against one another and against the first means 62 when the first means 62 is in its first position thereby to lock the plug contact blades in the housing 16. The clamping means 90 and 92 are positioned outboard of the respective socket contact bars 40 and 42 and are essentially mirror images of one another.

Clamping means 90 and 92 each include a camming member 94 that is eccentrically mounted on and rotatable with a shaft 96. Each shaft 96 is pivotably mounted in aligned, spaced apertures 98 and 100 (FIG. 7) formed in housing 16. The camming members 94 are each provided with serrated gripping portions 102 on an outer peripheral edge portion thereof to enhance the locking capabilities of the clamping means 90 and 92 relative to plug contact blades 32 and 34 when the latter are inserted into the socket. In addition, springs 104, each having one end 106 anchored to the camming member 94 and another end 108 anchored to housing 16, are employed to resilienly bias the serrated portions of the camming members 94 into contact with the plug contact blades.

Considering the overall operation of an electrical socket having a releaseable plug-locking mechanism in accordance with this invention at this time, it will be seen that prior to insertion of plug blades into the socket, the components of the socket are as illustrated in FIG. 2. Thus, the blocking means 62 is in its first position and the serrated portions 102 of clamping means 90 and 92 are resiliently biased against the free end portions of respective contact bars 42 and 44. When the contact blades of a plug are inserted into the socket, the camming members 94 of clamping means 90 and 92 pivot outwardly against their springs 104 to accommodate the insertion of the blades, as illustrated in FIG. 3. However, in the event a tugging force is applied to the cord of the plug, tending to pull the plug out of the socket, the serrations 102 dig into the plug blades, and the eccentrically mounted camming members pivot inwardly, tending to clamp the plug blades with greater force against the socket bars 42 and 44 and the parallel surface portions 82 and 82 of the blocking means 62.

When it is desired to remove the plug from the socket, the end 68 of actuating means 66 is depressed, causing the blocking means 62 to move to its second position, against the bias of springs 76, as illustrated in FIG. 4. This greatly diminishes the clamping force on the plug blades by allowing the free ends of the socket contact bars 42 and 44 to move towards one another. The plug blades may then be easily removed by a gentle tug on the plug.

Referring now to FIGS. 8, 9 and 10, an alternate, second, embodiment of this invention has been illustrated in which a modified electrical socket, shown generally at 110, is employed. The socket 110 is mounted on the end of an electrical extension cord 112, rather than in an electrical wall receptacle. As in the case of the first embodiment, the socket 110 of this embodiment includes an insulating housing **16*a* and a front end wall portion 24*a* that is provided with apertures 26*a*, 28*a* and 30*a* adapted to allow the contact blades 32 and 34 and the contact pin 36 of plug 38 to be inserted therethrough. Socket 110 also includes contact bars 42*a* and 44*a* having movable free ends (not shown) which correspond to the movable free ends 58 and 60 (FIG. 2**) of the first embodiment.

In addition, socket 110 is provided with clamping means, shown generally at **90*a* and 92*a*, which correspond to the clamping means 90 and 92 of the first embodiment, and each of the clamping means 90*a* and 92*a* includes a corresponding camming member 94*a* eccentrically mounted on a corresponding shaft 96*a* and biased by a spring 104*a* against contact blades 32, 34 and contact bars 42*a*, 44*a*. The socket 110 also is provided wih a corresponding blocking means 62*a* having a corresponding wedge member 64*a* movable between a first position, shown in FIG. 9, wherein it cooperates with the clamping means 90*a* and 92*a* to inhibit removal of the plug contact blades 32,34 from the socket in a manner similar to that described in connection with the first embodiment, and a second position, shown in FIG. 10, wherein it allows the plug contact blades 32, 34** to be easily removed from the socket.

Socket 110 further includes an actuating means **66*a* which is employed to move the wedge member 64*a* from its first position to its second position against the bias of springs 76*a*, as in the first embodiment. Actuating means 66*a* comprises an annular member 114 rotatably carried on the outer surface of housing 16*a* and having an inwardly projecting camming surface 116 formed on the inner surface thereof. When the annular member 114 is angularly rotated between the positions shown in FIGS. 9 and 10, camming surface 116 moves into and out of engagement with a cam following surface 118 formed on the end of wedge member 64*a* opposite the end thereof against which the springs 76*a*** abut, causing the wedge member to move between its first and second positions.

Referring now to FIGS. 11 and 12, a third embodiment of this invention has been illustrated in which a further modified electrical socket, shown generally at 120, is employed. The socket 120 is also of the type adapted to be mounted on the end of an extension cord (not shown), rather than in an electrical wall receptacle. As in the cases of the earlier embodiments, the socket 120 of this embodiment includes an insulating housing **16*b* and a front end wall portion 24*b* that is provided with apertures, two of which are shown at 26*b* and 30*b*, adapted to allow the contact blades, one of which is shown at 32, and the contact pin 36 of plug 38 to be inserted therethrough. Socket 120 also includes two contact bars, one of which is shown at 44*b*, having movable free ends (not shown) which correspond to the movable free ends 58 and 60 (FIG. 2**) of the first embodiment.

In addition, socket 120 is provided with clamping means, one of which is shown generally by broken lines at **92*b*, which correspond to the clamping means 90 and 92 of the first embodiment, and each of the clamping means of socket 120 includes a corresponding camming member 94*b* eccentrically mounted on a corresponding shaft 96*b* and biased by a corresponding spring (not shown) against the contact blades of plug 38 and the contact bars of socket 120. The socket 120 also is provided with a corresponding blocking means 62*b* having a corresponding wedge member 64*b* movable between a first position, shown in FIG. 11, wherein it cooperates with the clamping means to inhibit removal of the plug contact blades 32,34 from the socket in a manner similar to that described earlier in connection with the first two embodiments, and a second position, shown in FIG. 12**, wherein it allows the plug contact blades to be easily removed from the socket.

Socket 120 further includes an actuating means **66*b* which is employed to move the wedge member 64*b* from its first position to its second position against the bias of springs 76*b*, as in the earlier embodiments. Actuating means 66*b* comprises a lever 122 that is pivotably mounted intermediate its ends in an opening 124 formed in the housing 16*b*. Lever 122 is provided with a camming surface 126 at one of its end portions that moves radially inwardly of the socket when the other end portion 128 of the lever is raised and moves radially outwardly of the socket when the other end portion is lowered. The radially inward movement of the camming surface 126 causes a cam following surface 130 on wedge member 64*b* to correspondingly move, against the bias of springs 76*b*, resulting in movement of the wedge member from its first position to its second position. The wedge member moves back from its second position to its first position when the end portion 128** of the lever is again lowered.

Figure 13:
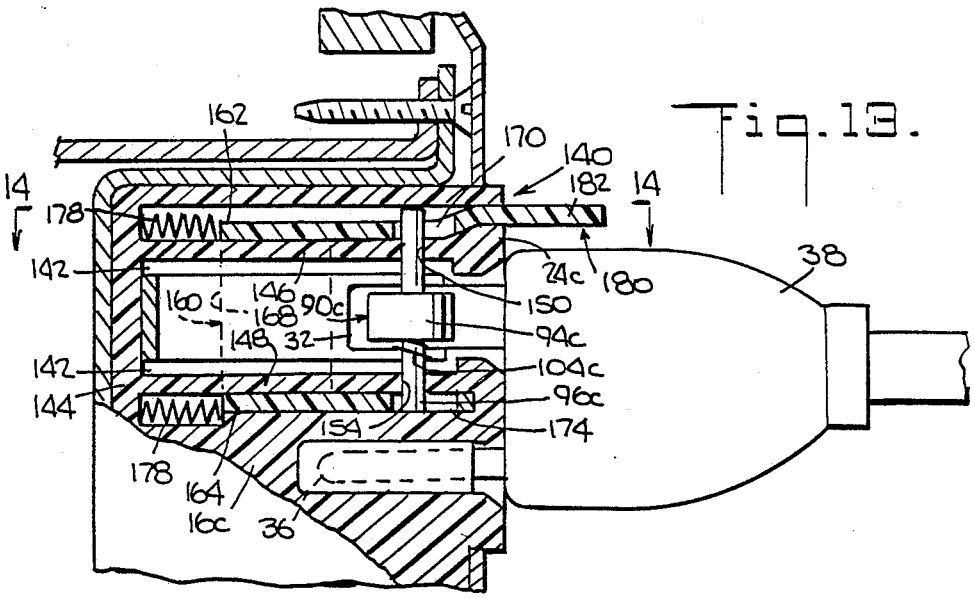
FIGS. 13 and 14 are sectional views, taken along the lines 13—13 and 14—14 of FIGS. 14 and 13, respectively, of a further embodiment of this invention, in this case illustrating the electrical socket in a wall-mounted receptacle and employing yet another form of releasable locking mechanism therein; and, FIG. 15 is a partially exploded perspective view, with parts omitted for clarity, of the releasable locking mechanism of the embodiment shown in FIGS. 13 and 14.
Figure 14:
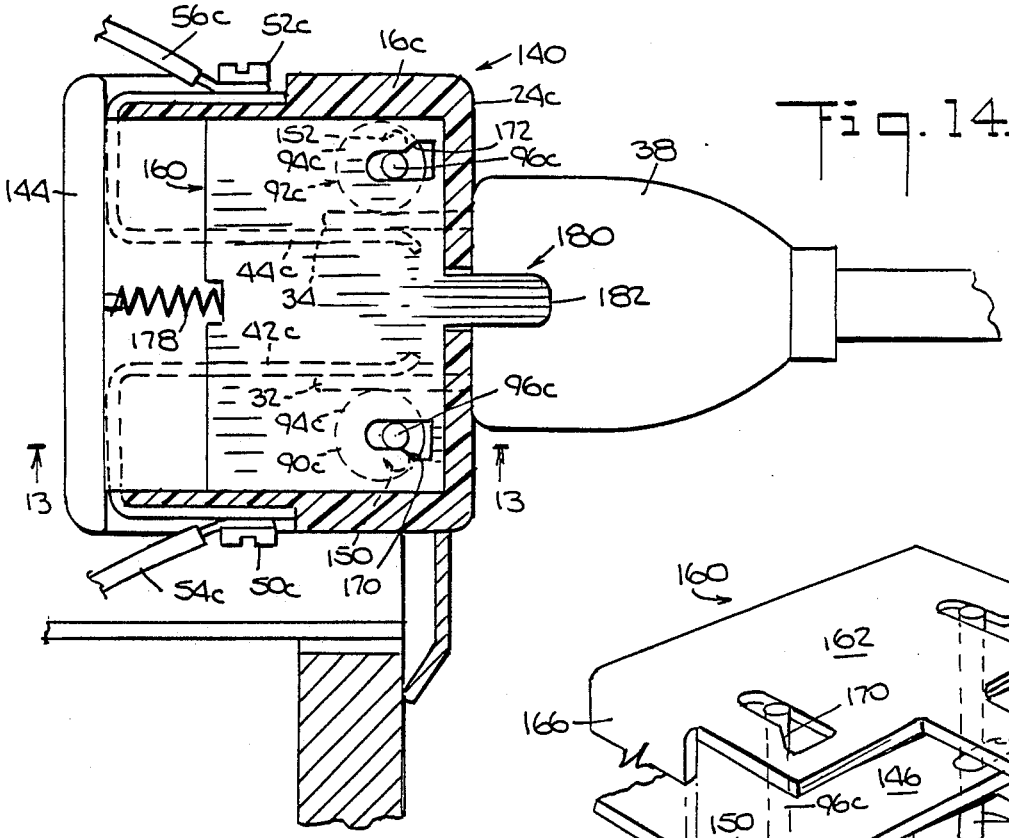
Figure 15:
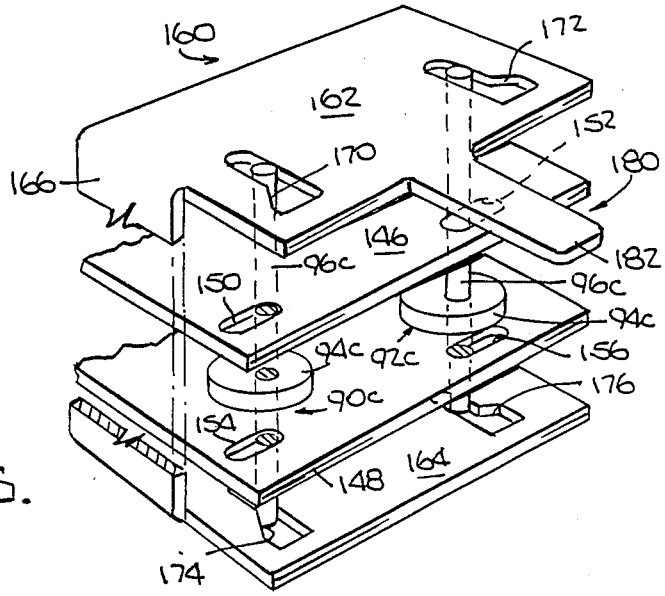

Referring to FIGS. 13, 14 and 15 at this time, a fourth embodiment of the invention has been illustrated in which a still further modified electrical socket, shown generally at 140, is employed. In this embodiment the socket has been been depicted in an electrical wall receptacle environment; however, it will be apparent that it can be employed in an extension cord environment as well.

The socket 140 differs somewhat in operation and arrangement from those described earlier herein in that instead of having socket contact bars with movable free ends that are unblocked to release the plug contact blades when a movable wedge member is shifted, the free ends of the socket contact bars are held in place by fixed insulating housing material that is positioned therebetween and the shafts of the eccentric camming members are transversely shifted to unclamp the plug contact blades. Thus, the socket 140 includes an insulating housing **16*c* having a central portion 142 thereof extending from the front wall 24*c* of the socket 140 to a rear wall 144 thereof at a location generally intermediate the contact blades 42*c*, 44*c*** of the socket and serving as a fixed barrier or blocking means which prevents the free ends of the contact blades from moving toward one another.

The housing **16*c* of socket 140 also includes upper and lower cam guide portions 146 and 148, respectively, which extend between the front wall 24*c* and rear wall 144 of the housing immediately above and below the central portion 142 of the housing. Transversely spaced, transversely extending slots 150 and 152 are provided in the upper cam guide 146 and corresponding transversely spaced, transversely extending slots 154 and 156 are provided in the lower cam guide 148, in alignment with the respective slots 150 and 152. Shaft 96*c* of clamping means 90*c* is movably positioned in slots 150 and 154 and is constrained to transverse movement by such slots. Similarly, shaft 96*c* of clamping means 92*c* is movably positioned in slots 152 and 156** and is constrained to transverse movement by these slots.

The shafts **96*c* of clamping means 90*c* and 92*c* are elongate and extend above and below the planes of the cam guides 146 and 148 into engagement with a camming means, shown generally at 160, which is mounted within the housing 16*c* for movement between first and second positions and is coupled to the clamping means 90*c* and 92*c* for moving the clamping means between an actuated condition, shown in FIG. 14, at which removal of the plug contact blades 32 and 34 from the socket is inhibited, and a deactuated condition, not shown, at which the plug contact blades are freely removable from the socket. The camming means 160 includes upper and lower plates 162 and 164, respectively, interconnected by side plates 166 and 168. Transversely spaced, longitudinally extending camming slots or surfaces 170 and 172 are provided in the upper plate 162 and corresponding transversely spaced, longitudinally extending slots or camming surfaces 174 and 176 are provided in lower plate 164, in alignment with the respective slots 170 and 172**.

When the camming means 160 is in its first position, as shown in FIGS. 13–15, the camming surfaces 170–176 cam the clamping means **90*c* and 92*c* toward one another into their actuated condition, in which condition they clamp the plug contact blades 32 and 34 against the socket contact bars 42*c*, 44*c* and against the central portion 142 of housing 16*c*. When the camming means 160 is in its second position, moved to the left against springs 178 as viewed in FIGS. 13 and 14, the camming surfaces 170–176 allow the clamping means 90*c* and 92*c*** to move apart to their deactuated condition, in which condition they no longer clamp the plug contact blades against the socket contact bars and allow the plug to be disconnected from the socket.

The camming means 160 is moved from its first position to its second position by an actuating means, shown generally at 180, which is accessible from outside of the housing **16*c* and is coupled to the camming means 160 within the housing 16*c*. The actuating means 180 preferably comprises a push rod 182 that is integral with or fixed to the upper plate 162**.

From the foregoing description, it is apparent that the present invention provides an improved electrical socket having a releaseable plug-locking mechanism therein that is safe to use, avoids the inconveniences associated with earlier electrical sockets provided with releaseable plug-locking mechanisms, and employs a simple, positive, locking arrangement that will operate effectively over a long, relatively trouble-free, service life.

While there have been shown and described what are presently considered to be the preferred embodiments of this invention, it will be obvious to those skilled in the art that various other changes and modifications may be made without departing from the broader aspects of this invention. It is, therefore, aimed in the appended claims to cover all such changes and modifications as fall within the true spirit and scope of this invention.

What is claimed is:

1. An electrical socket, comprising a housing of insulating material having an apertured end wall adapted to allow a pair of electrically conductive contact blades of an electrical plug to be inserted therethrough; transversely spaced, electrically conductive, first and second contact bars positioned within said housing, said contact bars being adapted to be contacted by said contact blades; first and second clamping means positioned adjacent to and outboard of said first and second contact bars, respectively, for clamping said contact blades and said contact bars together, when actuated, to inhibit removal of said contact blades from said housing, and for unclamping said contact blades and contact bars, when deactuated, to allow removal of said contact blades from said housing; camming means mounted within said housing for movement between first and second positions and coupled to said first and second clamping means for moving said clamping means between their actuated and deactuated conditions; and, actuating means accessible from outside of said housing, extending through a wall of said housing and coupled to said camming means for moving said camming means between said first and second positions thereby to move said clamping means between said actuated and deactuated conditions.

2. An electrical socket according to claim 1, further including insulated abutment means positioned intermediate said contact bars for preventing transverse movement of said contact bars.

3. An electrical socket, comprising a housing of insulating material having an apertured end wall adapted to allow a pair of electrically conductive contact blades of an electrical plug to be inserted therethrough; transversely spaced, electrically conductive, first and second contact bars positioned within said housing, said contact bars being adapted to be contacted by said contact blades and being constructed and arranged for limited movement relative to said housing; first means carried by said housing and movable between first and second positions for blocking said limited movement of said contact bars when in said first position and allowing said limited movement of said contact bars when in said second position; and, second means movably carried by said housing for clamping said contact blades and contact bars against one another and against said first means when said first means is in said first position thereby to lock said contact blades in said housing, the movement of said first means to said second position serving to unclamp said contact blades and contact bars and to allow said contact blades to be withdrawn from said housing, wherein said first means includes a movable portion thereof carried by said housing intermediate said contact bars, and wherein said second means includes first and second movable portions thereof carried by said housing outboard of said contact bars, wherein said movable portion of said first means comprises a wedge member, said first means further comprising actuating means extending through a wall of said housing and coupled to said first means within said housing for moving said first means between its first and second positions, and wherein said first and second movable portions of said second means comprise respective first and second pivotable, eccentrically mounted, cam members resiliently biased to urge said contact blades and contact bars toward said wedge member.

4. An electrical socket according to claim 3, wherein said housing includes a cylindrical outer surface, wherein said actuating member comprises an annular member rotatably carried on said outer surface of said housing, and wherein said camming surface is carried on an inner surface of said annular member and projects into the interior of said housing from said annular member.

5. An electrical socket according to claim 3, wherein said actuating member and said camming surface comprise opposite end portions of a lever that is pivotably mounted intermediate its ends to said housing so that raising said actuating member causes said camming surface to move said wedge member.

6. An electrical socket according to claim 3, wherein said actuating member comprises a push button, and wherein said push button and said camming surface are integrally interconnected with one another.

7. An electrical socket according to claim 3, wherein said actuating means includes a camming surface portion positioned internally of said housing and an actuating member positioned externally of said housing and coupled to said camming surface portion, wherein said wedge member includes a cam following surface portion in engagement with said camming surface portion within said housing, and wherein said first means further includes resilient means positioned intermediate said wedge member and said housing for biasing said cam following surface portion into engagement with said camming surface portion.

8. An electrical socket, comprising a housing of insulating material having an apertured end wall adapted to allow a pair of electrically conductive contact blades of an electrical plug to be inserted therethrough; transversely spaced, electrically conductive, first and second contact bars positioned within said housing, said contact bars being adapted to be contacted by said contact blades and being constructed and arranged for limited movement relative to said housing; first means carried by said housing and movable between first and second positions for blocking said limited movement of said contact bars when in said first position and allowing said limited movement of said contact bars when in said second position; and, second means movably carried by said housing for clamping said contact blades and contact bars against one another and against said first means when said first means is in said first position thereby to lock said contact blades in said housing, the movement of said first means to said second position serving to unclamp said contact blades and contact bars and to allow said contact blades to be withdrawn from said housing, wherein said first means includes a movable portion thereof carried by said housing intermediate said contact bars, and wherein said second means includes first and second movable portions thereof carried by said housing outboard of said contact bars, wherein said movable portion of said first means comprises a wedge member, said first means further comprising actuating means extending through a wall of said housing and coupled to said first means within said housing for moving said first means between its first and second positions, and wherein said actuating means includes a camming surface portion positioned internally of said housing and an actuating member positioned externally of said housing and coupled to said camming surface portion, wherein said wedge member includes a cam following surface portion in engagement with said camming surface portion within said housing, and wherein said first means further includes resilient means positioned intermediate said wedge member and said housing for biasing said cam following surface portion into engagement with said camming surface portion.

9. An electrical socket according to claim 8, wherein said housing includes a cylindrical outer surface, wherein said actuating member comprises an annular member rotatably carried on said outer surface of said housing, and wherein said camming surface is carried on an inner surface of said annular member and projects into the interior of said housing from said annular member.

10. An electrical socket according to claim 8, wherein said actuating member and said camming surface comprise opposite end portions of a lever that is pivotably mounted intermediate its ends to said housing so that raising said actuating member causes said camming surface to move said wedge member.

11. An electrical socket according to claim 8, wherein said actuating member comprises a push button, and wherein said push button and said camming surface are integrally interconnected with one another.

* * * * *